US006756915B2

(12) United States Patent
Choi

(10) Patent No.: US 6,756,915 B2
(45) Date of Patent: Jun. 29, 2004

(54) GEOGRAPHIC INFORMATION SERVICE APPARATUS AND METHOD USING A DSRC NETWORK

(75) Inventor: Kwang-Joo Choi, Kyungki-Do (KR)

(73) Assignee: LG Electronics Inc., Seoul (KR)

( * ) Notice: Subject to any disclaimer, the term of this patent is extended or adjusted under 35 U.S.C. 154(b) by 88 days.

(21) Appl. No.: 09/983,781

(22) Filed: Oct. 25, 2001

(65) Prior Publication Data

US 2002/0080048 A1 Jun. 27, 2002

(30) Foreign Application Priority Data

Dec. 22, 2000 (KR) ..... 2000-80406

(51) Int. Cl.[7] ..... G08G 1/065
(52) U.S. Cl. ..... 340/928; 235/384; 340/905
(58) Field of Search ..... 340/928, 905, 340/995, 995.13, 995.12; 701/117; 235/384

(56) References Cited

U.S. PATENT DOCUMENTS 5,543,789 A * 8/1996 Behr et al. ..... 340/995
5,805,082 A * 9/1998 Hassett ..... 340/928
6,233,519 B1 * 5/2001 Yamada ..... 701/200
6,300,882 B1 * 10/2001 Inoue ..... 340/933
6,314,352 B1 * 11/2001 Kunimatsu et al. ..... 701/36
6,463,384 B1 * 10/2002 Kaplan et al. ..... 701/200
6,501,391 B1 * 12/2002 Racunas, Jr. ..... 340/932.2

* cited by examiner

*Primary Examiner*—Brent A. Swarthout
(74) *Attorney, Agent, or Firm*—Fleshner & Kim, LLP

(57) ABSTRACT

A geographic information service system is disclosed, having a geographic information supply server that supplies geographic information by certain regions; an Electronic Toll Collection (ETC) terminal that transmits registration information service requests and geographic information service requests from a vehicle; a Dedicated Short Range Communication (DSRC) base station that communicates bi-directionally with the ETC terminal by a DSRC method; and a DSRC server in communication with the DSRC base station that analyzes a message transmitted from the DSRC base station and supplies a requested geographic information service by communicating with the geographic information supply server.

19 Claims, 3 Drawing Sheets

GEOGRAPHIC INFORMATION SERVICE APPARATUS AND METHOD USING A DSRC NETWORK

BACKGROUND OF THE INVENTION

1. Field of the Invention

The present invention relates to an Intelligent Transport System (ITS) and, in particular, to a geographic information service apparatus using a Dedicated Short Range Communication (DSRC) network.

2. Background of the Related Art

Many countries all over the world have researched a more efficient transportation-related system to relieve serious traffic problems and their concomitant logistics expenses. Much of this research has focused on the use of information and communication technologies to mitigate the problems. Accordingly, an intelligent transportation system that is capable of maximizing usage of the existing facilities has been introduced. The intelligent system makes information flow smoothly and without disruption between a vehicle and a road by adding technologies related to electronics, control, information, communication etc. to the existing transportation system such as a road, a vehicle, a signaling system etc.

The intelligent transportation system can be categorized as an advanced traffic management system, an advanced traveler information system, an advanced public transportation system, an advanced commercial vehicle system, and an advanced vehicle and highway system etc., in accordance with the adaptation field. The intelligent transportation system may adapt a dedicated short range Intelligent Transport System (ITS) communication network in order to supply various services through the real-time collection and distribution of transportation information.

In the dedicated ITS communication network, particularly a DSRC network, is a communication network for performing a two-way communication. The network employs high speed wireless packet communication between a DSRC terminal, installed in a vehicle, and road side equipment located within a wireless communication range. The DSRC system can collect tolls automatically in a parking lot or a toll road. It may analyze transportation conditions of a road by collecting information related to regional transit vehicles, and provide the analyzed transportation conditions to a driver.

Presently though, the DSRC system only can supply limited services such as an automatic toll collection, it can not supply various additional desirable services to a user.

SUMMARY OF THE INVENTION

An object of the invention is to solve at least the above problems and/or disadvantages and to provide at least the advantages described hereinafter.

In order to solve the above-mentioned problem, an object of the present invention is to provide a geographic information service apparatus using a DSRC network and a method of operation that is capable of supplying geographic guidance information.

Another object of the present invention is to provide a geographic information service apparatus using a DSRC network and a method of operating the same that is capable of displaying for a driver an optimum route to a destination on a geographic guidance window by analyzing transportation flows, after collecting information of regional transit vehicles and referencing the analyzed result.

In order to achieve the objects of the present invention, there is provided a transportation information service apparatus using a DSRC network in accordance with the present invention which comprises a geographic information supply server for supplying geographic information by certain regions, an Electronic Toll Collection (ETC) terminal for transmitting registration information and geographic information service requests from a vehicle, a DSRC base station for performing two-way communication with the ETC terminal by the DSRC method, and a DSRC server for analyzing messages transmitted from the DSRC base station and supplying a requested geographic information service by interlocking with a geographic information supply server when the transmitted message in a geographic information request message.

The geographic information service operation method using the DSRC network in accordance with the present invention comprises checking a service mode of the ETC terminal, inputting a pertinent geographic information service request signal from a user in a geographic information service mode, generating a pertinent service request message according to the inputted geographic information service request signal and transmitting it to the DSRC server through the DSRC base station, requesting a geographic information service from the DSRC server to the geographic information supply server when the service request message is a geographic information service request message, transmitting geographic information from the DSRC server to the ETC terminal through the DSRC base station when the pertinent geographic information is transmitted from the geographic information supply server to the DSRC server, and displaying the pertinent geographic information received by the ETC terminal to a user through the DSRC base station.

The objects of the present invention may be achieved in whole or in part by a dedicated short range communication (DSRC) system, including a DSRC server that manages the operation of the system and communicates with a geographic information server; a base station that communicates with the DSRC server and communicates with a subscriber by a wireless DSRC protocol, wherein the DSRC server retrieves geographic information from the geographic information server and communicates the geographic information to the base station, in response to a request for the geographic information from the subscriber, and the base station communicates the geographic information to the subscriber.

The objects of the present invention may be further achieved in whole or in part by a remote communication subscriber device, including a radio frequency (RF) unit that communicates with a base station by radio frequency using a dedicated short range communication (DSRC) protocol; a media access control (MAC) unit that interfaces a communication channel between the subscriber and the base station; a touch screen unit that displays information to a user and supports information input by the user; and a service mode switch that selects a mode of service supported by the subscriber, wherein a first position of the service mode switch causes the multiple purpose subscriber to operate as a remote toll collection terminal, which communicates with a DSRC server via the base station to settle toll charges, which are managed by the DSRC server, in a subscriber account maintained by the multiple purpose subscriber, and a second position of the service mode switch causes the multiple purpose subscriber to operate as a remote geographic information service terminal, which communicates with the DSRC server via the base station to obtain and display geographic information or transportation information overlaid on the geographic information, which the DSRC server obtains by communicating with external servers providing the geographic and transportation information.

The objects of the present invention may be further achieved in whole or in part by a geographic information service method, including communicating a first request for geographic information from a subscriber to a base station using a wireless communication having a dedicated short range communication (DSRC) protocol; communicating the first request from the base station to a DSRC server that manages the operation of the base station; communicating a response from the DSRC server to the base station containing the geographic information requested; and communicating the response from the base station to the subscriber using the wireless communication.

The objects of the present invention may be further achieved in whole or in part by a geographic information service method, wherein a subscriber has a service mode switch that selects a mode of service supported by the subscriber, including when the switch is set for a geographic information service mode; communicating a first request for geographic information from the subscriber to a base station using a wireless communication having a dedicated short range communication (DSRC) protocol; communicating the first request from the base station to a DSRC server that manages the operation of the base station; communicating a response from the DSRC server to the base station containing the geographic information requested; and communicating the response from the base station to the subscriber using the wireless communication; and when the switch is set for a toll collection service mode; communicating subscriber registration information to the DSRC server, via the base station; communicating toll fee information from the DSRC server to the subscriber, via the base station; debiting the toll fee from a subscriber account maintained by the subscriber; and communicating a debit completion messages from subscriber to the DSRC server, via the base station.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Hereinafter, the preferred embodiments of the present invention will now be described in detail with reference to the accompanying drawings.

Figure 1:
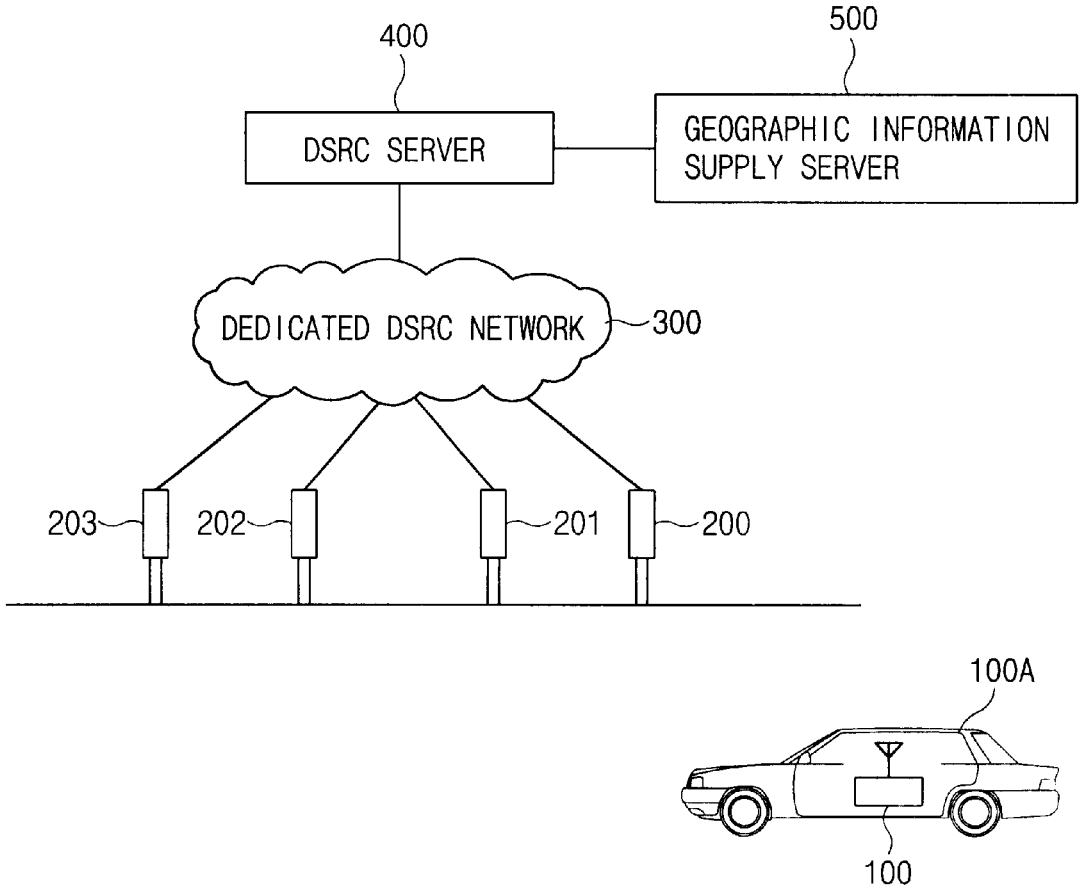
FIG. 1 illustrates a schematic block diagram of a geographic information service apparatus using a DSRC network in accordance with a preferred embodiment of the present invention.

FIG. 1 is a schematic block diagram illustrating a geographic information service apparatus using a DSRC network. The geographic information service apparatus includes a geographic information supply server 500 supplying geographic information related to certain regions; an Electronic Toll Collection (ETC) terminal 100 installed in a vehicle 100A and transmitting registration information and geographic information service requests from the vehicle; a plurality of DSRC base stations 200~203 each installed in a certain region and performing two-way communication with the ETC terminal 100 by the DSRC method; and a DSRC server 400 in communication with the DSRC base stations 200~203, via a dedicated DSRC network 300, and capable of requesting pertinent geographic guidance from a geographic information supply server 500, with which it communicates, by analyzing a message transmitted from the DSRC base stations 200~203, via the dedicated network 300, when the message is a geographic guidance request message, and transmitting the transmitted geographic information to the pertinent DSRC base stations 200~203, when the pertinent geographic information is transmitted from the geographic information supply server 500.

Figure 2:
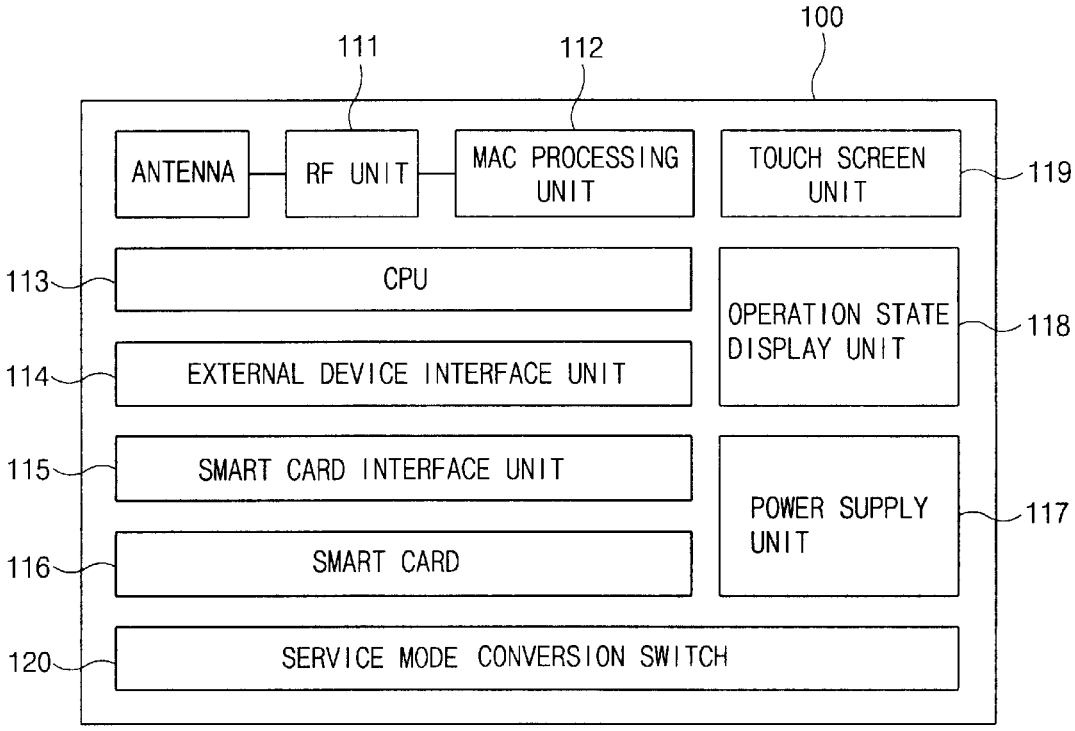
FIG. 2 illustrates the ETC terminal of FIG. 1 in greater detail.

Referring now to FIG. 2, the ETC terminal 100 includes a service mode conversion switch 120, which is used for converting between selected service modes, and a touch screen unit 119 used for requesting and displaying geographic information.

In more detail, a Radio Frequency (RF) unit 111 processes an RF signal for communicating with the base stations 200~203, by the DSRC method. A Media Access Control (MAC) processing unit 112 interfaces a communication channel with the base stations 200~203, by a Time Division Multiple Access (TDMA) method. A Central Processing Unit (CPU) 113 recognizes a service mode conversion, in accordance with an operation of the service mode conversion switch 120, and controls the operation of the ETC terminal according to the selected service mode. An external device interface unit 114 interfaces with an external device, such as an external display monitor, a notebook computer, a radio, a car audio system, a karaoke system, a small-capacity server, a DVD player, a mobile telephone, an IC card reader, etc., for the convenience of a user of the ETC terminal. For example, the external device interface unit 114 can interface with a Universal Serial Bus (USB), an RS-232C serial communication bus, or an RJ-45 network interface, etc. A smart card interface unit 115 reads information of a smart card 116 or records information on the smart card 116. A power supply unit 117 supplies power to each device of the ETC terminal 100 and an operation state display unit 118 displays an operation state of the ETC terminal 100.

The operation of the geographic information service apparatus will now be described in detail. When the vehicle 100A containing the installed ETC terminal 100 enters the communication range of a DSRC base station, for example base station 200, it receives an ETC broadcast message transmitted from the DSRC base station 200. The ETC terminal 100 receiving the ETC broadcast message sets a pertinent frequency channel. Using the pertinent frequency channel, the ETC terminal 100 sends a request to the DSRC base station 200, in a TDMA format, requesting an available channel. The DSRC base station 200 allocates a pertinent available channel and transmits it to the ETC terminal 100. Thereafter, the ETC terminal 100 performs two-way communication with the DSRC base station 200 using the allocated available channel.

For example, in automatic toll collection, the ETC terminal 100 reads identification (ID) information and balance information from the smart card 116 and transmits the information to the DSRC base station 200. The DSRC base station 200 transmits a corresponding reply message to the ETC terminal 100. The DSRC base station 200 transmits the message received from the ETC terminal 100 to the DSRC server 400, through the dedicated DSRC network 300. The DSRC server 400 analyzes the message transmitted from the DSRC base station 200, performs a service function based on the received information, and transmits the pertinent service information to the DSRC base station 200. The DSRC base station 200 supplies the pertinent service by transmitting the pertinent service information to the ETC terminal 100 by the DSRC method.

Continuing with the automatic toll collection example, the DSRC base station 200 transmits information about the toll to be collected and ID information of the ETC terminal. The ETC terminal 100 corresponding to the ETC terminal ID information subtracts a pertinent toll amount from its smart card 116 and transmits a toll collection completion message to the DSRC base station 200.

In other words, when the information about the toll to be collected is received through the RF unit 111 and MAC processing unit 112 of the ETC terminal 100, the CPU 113 subtracts the toll from the balance stored in the smart card 116. After that, the CPU 113 transmits the toll collection completion message to the DSRC processing unit 200, through the MAC processing unit 112, RF unit 111 and an antenna (not shown). The ETC terminal 100 displays a reception state and a power state on the operation state display unit 118 and displays a statement of accounts on the touch screen unit 119, when the payment of the toll is completed.

Next, other services supplied to a driver by using the ETC terminal will be described.

Figure 3:
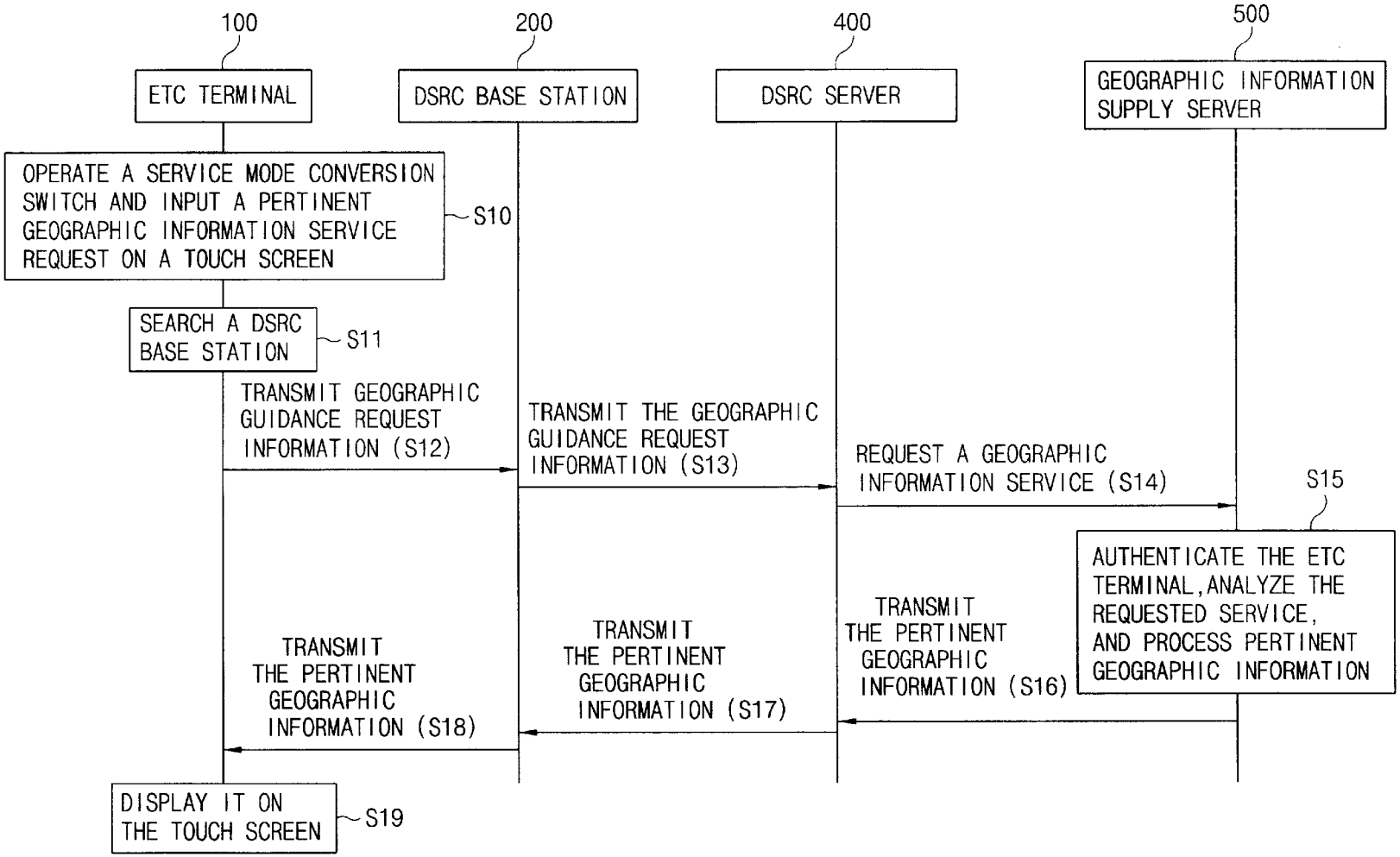
FIG. 3 illustrates a flow chart of a geographic information service operation method, in accordance with a preferred embodiment of the present invention.

The driver converts a mode of the ETC terminal into a desired pertinent service mode by operating the service mode conversion switch 120. The CPU 113 senses a service mode of the ETC terminal 100 according to the operation of the service mode conversion switch 120. When the sensed service mode is converted into the geographic information service mode, the CPU 113 displays a menu on the touch screen unit 119 for supplying a geographic information service. When a pertinent destination is touch selected on the menu screen by the driver, the ETC terminal 100 searches for a DSRC base station capable of performing the DSRC communication, as illustrated at S10, S11 in the flow chart of FIG. 3.

When the ETC finds a DSRC base station, for example base station 200, capable of performing the DSRC communication, the ETC terminal 100 transmits a pertinent geographic information service request message, inputted by the driver through the touch screen 119, to the DSRC base station 200. A TDMA channel allocated from the DSRC base station 200 is used to communicate the message, as illustrated at S12.

The DSRC base station 200 transmits the geographic information service request message to the DSRC server 400 through the dedicated DSRC network 300, as in step S13. The DSRC server 400 checks the request message received from the DSRC base station 200. When the message is a geographic information service request message, the DSRC server 400 transmits the received geographic information service request message to the geographic information supply server 500, as shown at S14.

The geographic information supply server 500 performs a certification of the ETC terminal 100 transmitting the geographic information service request message. If the certification is successful, the pertinent geographic information requested is processed and the processed geographic information is transmitted to the DSRC server 400, S15 and S16.

In other words, when the geographic information service request message describes a geographic information request about a pertinent destination, the geographic information supply server 500 process geographic information about the destination and transmits it to the DSRC server 400, as shown at S15.

Then, the DSRC server 400 transmits the pertinent geographic information received from the geographic information supply server 500 to the DSRC base station 200, through the dedicated DSRC network 300 as shown at S16, S17. The DSRC base station 200 transmits the received pertinent geographic information by the DSRC method, S18, and the ETC terminal 100 receives the pertinent geographic information and displays the received pertinent geographic information on the touch screen unit 119, S19. In other words, the ETC terminal 100 displays the geographic information about the destination on the touch screen unit 119 in a map format, as shown at S18, S19.

When the menu for supplying the geographic information service is displayed on the touch screen unit 119 and a menu selection for optimum route information about a pertinent destination is inputted by the driver, at S10, the ETC terminal 100 generates a pertinent geographic information service request message and the processes as shown at S11~S14 are performed by the same method.

When the received pertinent geographic information service request message describes an optimum route request to a pertinent destination, the geographic information supply server 500 generates optimum route information, according to transportation conditions, by linking with a transportation information supplier. The geographic information supply server 500 transmits the optimum route information with geographic information about the destination to the DSRC server 400, as shown at S15, S16.

Alternatively, the DSRC server 400 can generate optimum route information to the destination, according to the present transportation conditions, by linking directly with the transportation information supplier and the geographic information supply server 500.

The received optimum route information to the destination is transmitted to the ETC terminal 100 through the DSRC base station 200, as shown at S17, S18.

The ETC terminal 100 displays the optimum route from the present position to the destination on the touch screen unit 119, based on the received optimum route information, as shown at S19.

As one illustrative embodiment in accordance with the present invention, the method for supplying a geographic information service using the DSRC network to the ETC terminal by interlocking with the DSRC server and geographic information supply server has been described.

However, the present invention can provide various ITS services using the DSRC network by interfacing the DSRC server with a server for an Advanced Traffic Management System (ATMS) service, a server for an Advanced Traveler Information System (ATIS) service, a server for an Advanced Public Transportation System (APTS) service, a server for an Advanced Commercial Vehicle System (ACVS) service, a server for an Advanced Vehicle and Highway System (AVHS) service, etc.

As described above, in the geographic information service apparatus using the DSRC network and the operation method of the same in accordance with the present invention, because the ETC supplies geographic information about the certain region to the driver, the driver can cope efficiently with the real-time road conditions in a certain region and, accordingly, the present invention can relieve the congestion of traffic.

And, by the present invention, the driver can be supplied with various services such as the automatic toll collection service, geographic information service etc. by using one ETC terminal having the service mode conversion switch and touch screen unit.

In addition, the present invention can perform various services by using the DSRC network, and accordingly the present invention can improve the usage efficiency of the DSRC network.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A geographic information service system comprising:

a geographic information supply server that supplies geographic information by certain regions;

an Electronic Toll Collection (ETC) terminal that transmits registration information service requests and geographic information service requests from a vehicle;

a Dedicated Short Range Communication (DSRC) base station that communicates bi-directionally with the ETC terminal by a DSRC method; and a DSRC sewer in communication with the DSRC base station that analyzes a message transmitted from the DSRC base station and supplies a requested geographic information service by communicating with the geographic information supply server;

wherein the ETC terminal further comprises a service mode conversion switch that converts a service mode of the ETC terminal in accordance with an operation of a user, a Central Processing Unit (CPU) that recognizes the service mode and controls an operation of the ETC terminal, according to the pertinent service mode, and a touch screen unit that transmits the geographic information service requests, inputted by the user, to the CPU and displays the pertinent geographic information received from the DSRC base station, under the control of the CPU.

2. The geographic information service system of claim 1, wherein the DSRC server generates optimum route information from a present position to a destination, in accordance with transportation conditions, by linking directly with a transportation information supplier supplying transportation information about the certain regions, and on the basis of the geographic information supplied by the geographic information supply server.

3. The geographic information service system of claim 1, wherein the geographic information supply server generates optimum route information from a present position to a destination, in accordance with transportation conditions, by linking directly with a transportation information supplier supplying transportation information about the certain regions and transmitting the transportation information to the DSRC server.

4. A geographic information service method, comprising:

transmitting a service request message generated in an Electronic Toll Collection (ETC) terminal, according to user specified information, to a DSRC server through a DSRC base station;

sending a geographic information service request from the DSRC server to a geographic information supply server;

transmitting geographic information generated by the geographic information supply server from the DSRC server to the ETC terminal, through the DSRC base station; and displaying the geographic information received by the ETC terminal to a user;

wherein a service mode of the ETC terminal is determined in accordance with an operation of a service mode conversion switch in the ETC terminal.

5. The geographic information service method of claim 4, wherein the service mode conversion switch is operated by the user of the ETC terminal.

6. The geographic information service method of claim 4, further comprising:

displaying an initial screen to the user enabling the user to input the geographic information service request; and inputting a menu selection on the initial screen, by a touch screen manipulation, to request the geographic information.

7. The geographic information service method of claim 4, further comprising:

performing a certification function by the geographic information supply server about the ETC terminal which transmitted the geographic information service request message;

checking a type of the received geographic information service request message when the certification is successful; and generating and transmitting the geographic information about a destination to the DSRC server.

8. The geographic information service method of claim 7, further comprising:

generating optimum route information from a present position of the ETC terminal to a destination, in accordance with transportation conditions, by linking with a transportation information supplier and transmitting the generated route information to the DSRC server.

9. The geographic information service method of claim 4, further comprising:

generating optimum route information to a destination, in accordance with transportation conditions, by requesting transportation information from a present position of the ETC terminal to a destination from a transportation information supplier and using the geographic information to the destination supplied by the geographic information supply server.

10. A dedicated short range communication (DSRC) system, comprising:

a DSRC server that manages the operation of the system and communicates with a geographic information server;

a base station that communicates with the DSRC server and communicates with a subscriber by a wireless DSRC protocol; and a multiple purpose subscriber having a service mode switch that selects a mode of service supported by the multiple purpose subscriber;

wherein the DSRC server retrieves geographic information from the geographic information server and communicates the geographic information to the base station, in response to a request for the geographic information from the subscriber, the base station communicates the geographic information to the subscriber, a first position of the service mode switch causes the multiple purpose subscriber to operate as a remote toll collection terminal, which communicates with the DSRC server via the base station to settle toll charges in a subscriber account maintained by the multiple purpose subscriber, and a second position of the service mode switch causes the multiple purpose subscriber to operate as a remote geographic information service terminal, which communicates with the DSRC server via the base station to obtain and display the geographic information or transportation information overlaid on the geographic information.

11. The system of claim 10, wherein:

the DSRC server obtains transportation information from a transportation information server, with which it communicates, and communicates both the geographic information and the transportation information to the base station, in response to a request for a travel route from the subscriber, and the base station communicates the geographic and transportation information to the subscriber.

12. A dedicated short range communication (DSRC) system, comprising:

a DSRC server that manages the operation of the system and communicates with a geographic information server;

a base station that communicates with the DSRC server and communicates with a subscriber by a wireless DSRC protocol; and a multiple purpose subscriber having a service mode switch that selects a mode of service supported by the multiple purpose subscriber;

wherein the DSRC server retrieves geographic information from the geographic information server and communicates the geographic information to the base station, in response to a request for the geographic information from the subscriber, the base station communicates the geographic information to the subscriber, a first position of the service mode switch causes the multiple purpose subscriber to operate as a remote traffic management terminal, which communicates with the DSRC server via the base station to obtain traffic management information from an advanced traffic management system with which the DSRC server communicates, a second position of the service mode switch causes the multiple purpose subscriber to operate as a remote traveler information service terminal, which communicates with the DSRC server via the base station to obtain traveler information from a traveler information system with which the DSRC server communicates, a third position of the service mode switch causes the multiple purpose subscriber to operate as a remote public transportation information terminal, which communicates with the DSRC server via the base station to obtain public transportation information from an advanced public transportation information system with which the DSRC server communicates, and a fourth position of the service mode switch causes the multiple purpose subscriber to operate as a remote vehicle and highway information service terminal, which communicates with the DSRC server via the base station to obtain vehicle and highway information from an advanced vehicle and highway information system with which the DSRC server communicates.

13. The system of claim 12, wherein:

the DSRC server obtains transportation information from a transportation information server, with which it communicates, and communicates both the geographic information and the transportation information to the base station, in response to a request for a travel route from the subscriber, and the base station communicates the geographic and transportation information to the subscriber.

14. A remote communication subscriber device, comprising:

a radio frequency (RF) unit that communicates with a base station by radio frequency using a dedicated short range communication (DSRC) protocol;

a media access control (MAC) unit that interfaces a communication channel between the subscriber and the base station;

a touch screen unit that displays information to a user and supports information input by the user; and a service mode switch that selects a mode of service supported by the subscriber, wherein a first position of the service mode switch causes the subscriber to operate as a remote toll collection terminal, which communicates with a DSRC server via the base station to settle toll charges, which are managed by the DSRC server, in a subscriber account maintained by the subscriber, and a second position of the service mode switch causes the subscriber to operate as a remote geographic information service terminal, which communicates with the DSRC server via the base station to obtain and display geographic information or transportation information overlaid on the geographic information, which the DSRC server obtains by communicating with external servers providing the geographic and transportation information.

15. The remote communication subscriber device of claim 14, wherein:

a third position of the service mode switch causes the subscriber to operate as a remote traffic management terminal, which communicates with the DSRC server via the base station to obtain traffic management information from an advanced traffic management system with which the DSRC server communicates, and a fourth position of the service mode switch causes the subscriber to operate as a remote traveler information service terminal, which communicates with the DSRC server via the base station to obtain traveler information from a traveler information system with which the DSRC server communicates, a fifth position of the service mode switch causes the subscriber to operate as a remote public transportation information terminal, which communicates with the DSRC server via the base station to obtain public transportation information from an advanced public transportation information system with which the DSRC server communicates, and a sixth position of the service mode switch causes the subscriber to operate as a remote vehicle and highway information service terminal, which communicates with the DSRC server via the base station to obtain vehicle and highway information from an advanced vehicle and highway information system with which the DSRC server communicates.

16. A geographic information service method, wherein a subscriber has a service mode switch that selects a mode of service supported by the subscriber, comprising:

when the switch is set for a geographic information service mode:

communicating a first request for geographic information from the subscriber to a base station using a wireless communication having a dedicated short range communication (DSRC) protocol;

communicating the first request from the base station to a DSRC server that manages the operation of the base station;

communicating a response from the DSRC server to the base station containing the geographic information requested; and communicating the response from the base station to the subscriber using the wireless communication; and when the switch is set for a toll collection service mode:

communicating subscriber registration information to the DSRC server, via the base station;

communicating toll fee information from the DSRC server to the subscriber, via the base station;

debiting a toll fee from a subscriber account maintained by the subscriber; and communicating a debit completion message from the subscriber to the DSRC server, via the base station.

17. The geographic information service method of claim 16, wherein when the service mode switch is set for the geographic information service mode, further comprising:

communicating a second request for travel route information from the subscriber to the base station using the wireless communication;

communicating the second request from the base station to the DSRC server;

communicating the second request from the DSRC server to a transportation information server to retrieve real-time transportation information that may affect travel time along a number of routes;

selecting a travel route based on the transportation information and the geographic information and communicating the travel route to the subscriber, via the base station; and displaying the travel route as an overlay on the geographic information for viewing by a user on a touch screen of the subscriber.

18. A geographic information service system comprising:

a geographic information supply server that supplies geographic information by certain regions;

an Electronic Toll Collection (ETC) terminal that transmits registration information service requests and geographic information service requests from a vehicle;

a Dedicated Short Range Communication (DSRC) base station that communicates bi-directionally with the ETC terminal by a DSRC method;

a DSRC server in communication with the DSRC base station that analyzes a message transmitted from the DSRC base station and supplies a requested geographic information service by communicating with the geographic information supply server; and a service mode conversion switch that converts a service mode of the ETC terminal in accordance with an operation of a user.

19. A geographic information service method, comprising:

communicating a first request for geographic information from a subscriber to a base station using a wireless communication having a dedicated short range communication (DSRC) protocol when a service mode select switch is in a geographic service mode, wherein the service mode select switch selects between a toll collection mode and the geographic service mode;

communicating the first request from the base station to a DSRC server that manages the operation of the base station;

communicating a response from the DSRC server to the base station containing the geographic information requested; and communicating the response from the base station to the subscriber using the wireless communication.

* * * * *